United States Patent [19]

Adams et al.

[11] Patent Number: 4,916,923

[45] Date of Patent: Apr. 17, 1990

[54] BEVERAGE COOLER INSERT

[76] Inventors: Carol A. Adams; James D. Adams, both of 174 N. Rancho Ave., San Bernadino, Calif. 92410

[21] Appl. No.: 339,214

[22] Filed: Apr. 17, 1989

[51] Int. Cl.[4] ..... F25D 3/08

[52] U.S. Cl. ..... 62/457.1; 62/457.5; 62/457.7; 62/466; 62/530

[58] Field of Search ..... 62/457.1, 457.5, 457.7, 62/465, 466, 530

[56] References Cited

U.S. PATENT DOCUMENTS

| | | | |
|---|---|---|---|
| 569,506 | 10/1896 | Millard | 62/457.1 |
| 2,512,077 | 6/1950 | Walker | 62/466 |
| 4,424,687 | 1/1984 | Morgan | 62/457.1 |
| 4,441,336 | 4/1984 | Cannon | 62/457.5 |
| 4,515,421 | 5/1985 | Steffes | 62/457.1 X |
| 4,671,079 | 6/1987 | Petrantoni | 62/457.7 |
| 4,821,525 | 4/1989 | Drummond, III et al. | 62/530 |

*Primary Examiner*—Lloyd L. King
*Attorney, Agent, or Firm*—Leon Gilden

[57] ABSTRACT

A beverage cooler insert is set forth wherein a first support tray is reciprocatably mounted relative to a second support tray with each support tray provided with an individual "U" shaped suppport bracket to be received within an associated container cooler arrangement. The first and second support trays are reciprocatably mounted relative to one another utilizing support posts telescopingly received within support sleeves and biased outwardly relative to one another to effect engagement of the sides of the beverage cooler container by the support trays. Each support tray 12 is provided with series of cylindrical cavities provided with slots through side walls of the cavity to effect contact of a cooling medium with containers positioned within the cavities.

8 Claims, 1 Drawing Sheet

BEVERAGE COOLER INSERT

BACKGROUND OF THE INVENTION

1. Field of the Invention

The field of invention relates to beverage cooler devices, and more particularly pertains to a new and improved beverage cooler insert for use in combination with beverage cooler containers of various sizes wherein the device is arranged for adjustment and a combination of various size cavities.

2. Description of the Prior Art

Beverage coolers of various types and arrangements are well known in the prior art. The beverage coolers of the prior art have heretofore been of unitary and predetermined size and configuration wherein the instant invention provides apparatus to accommodate cores of various sizes and cavities. An example of a prior art device is set forth in U.S. Pat. No. 2,562,108 to Lutz setting forth a refrigeration unit or compartmentalized beverage cooler wherein predetermined and prearranged bottle-containing compartments are positioned within the cavity with a central cavity accommodating a cooling medium.

U.S. Pat. No. 2,825,208 to Anderson sets forth a refrigeration unit wherein a series of cavities are arranged within a lid of predetermined configuration and size to accommodate infant feeding bottles of various and predetermined sizes.

U.S. Pat. No. 3,401,535 to Palmer sets forth a removable insert of a predetermined configuration and size that is positionable within a cooling container. The Palmer device, as the other prior art, fails to provide the insert with accommodation potential for accommodating the cavities of various containers.

U.S. Pat. No. 4,286,440 to Taylor sets forth a compartmentalized cooler provided with an insulated portion and a plurality of compartments to contain a cooling medium and beverage containers therewithin. The beverage containing compartments, as is consistent throughout the prior art, are of predetermined arrangement and configuration within the beverage cooler container.

U.S. Pat. No. 4,704,875 to Kieler sets forth a beverage cooler provided with angularly directed beverage cooler cavities directed outwardly from the sides of the beverage container to receive the cooling medium interiorly of the container.

As such, it may be appreciated that there is a continuing need for a new and improved beverage cooler insert that addresses both the problems of ease of use and effectiveness in construction, and in this respect, the present invention substantially fulfills this need.

SUMMARY OF THE INVENTION

In view of the foregoing disadvantages inherent in the known types of beverage cooler devices now present in the prior art, the present invention provides a beverage cooler insert wherein the same may be efficiently and readily positioned within beverage cooler containers of various sizes. As such, the general purpose of the present invention, which will be described subsequently in greater detail, is to provide a new and improved beverage cooler insert which has all the advantages of the prior art beverage cooling devices and none of the disadvantages.

To attain this, the present invention comprises a first and second spaced support tray, each formed with a "U" shaped support bracket to provide stability and position the trays above a floor of an associated container. The trays are each formed with a series of cylindrical cavities to accommodate containers within with the walls that further define cavities provided with various slots to direct a cooling medium interiorly of the cavities to effect cooling of the containers positioned therewithin. A first tray includes a plurality of rigid rods that are each telescopingly received within support tubes positioned and secured to the second tray wherein the support rods are telescopingly received resiliently within the support tubes to accommodate telescoping adjustment of the first tray to the second tray and thereby accommodate and arrange the insert within container cavities of various sizes.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention is order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved beverage cooler insert which has all the advantages of the prior art beverage cooling devices and none of the disadvantages.

It is another object of the present invention to provide a new and improved beverage cooler insert which may be easily and efficiently manufactured and marketed.

It is a further object of the present invention to provide a new and improved beverage cooler insert which is of a durable and reliable construction.

An even further object of the present invention is to provide a new and improved beverage cooler insert which is susceptible of a low cost of manufacture with regard to both materials and labor, and which accordingly is then susceptible of low prices of sale of the consuming public, thereby making such beverage cooler inserts economically available to the buying public.

Still yet another object of the present invention is to provide a new and improved beverage cooler insert which provides in the apparatus and methods of the prior art some of the advantages thereof, while simultaneously overcoming some of the disadvantages normally associated therewith.

Still another object of the present invention is to provide a new and improved beverage cooler insert wherein the same is resiliently and adjustably arranged to accommodate several containers of various sizes and of internal configurational variations.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
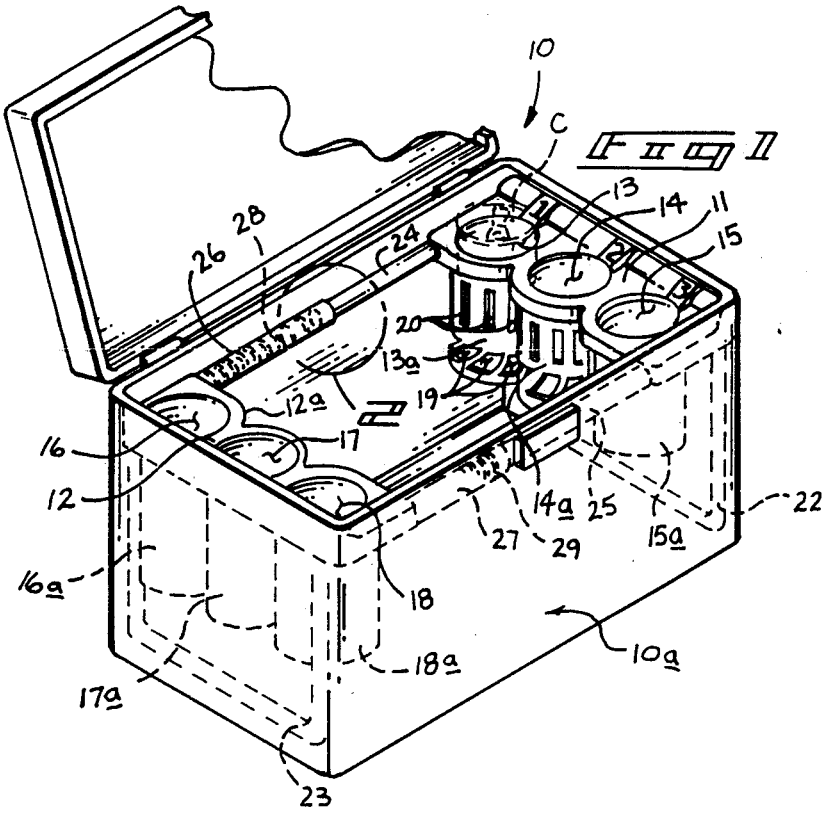
FIG. 1 is an isometric illustration of the instant invention in association with a beverage cooler container.
Figure 2:
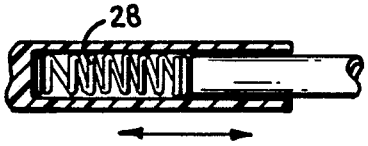
FIG. 2 is an orthographic view of the support rod and support tube and their association relative to one another.
Figure 3:
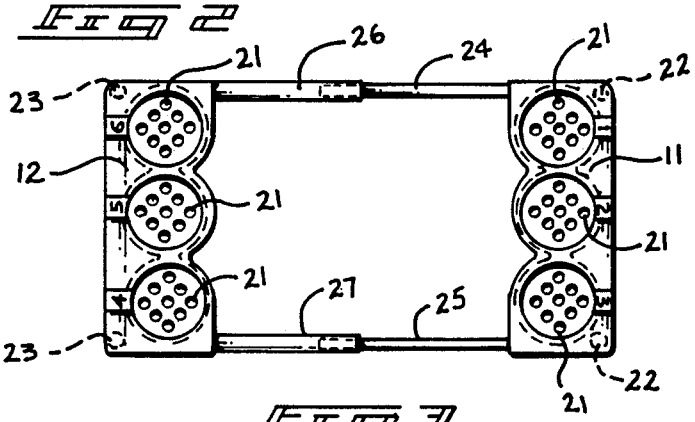
FIG. 3 is an orthographic top view of the insert of the instant invention.

With reference now to the drawings, and in particular to FIGS. 1 to 3 thereof, a new and improved beverage cooler insert embodying the principles and concepts of the present invention and generally designated by the reference numeral 10 will be described.

More specifically, it will be noted that the beverage cooler insert 10 essentially comprises a first support tray 11 formed with a planar top surface and an arcuate forward face 11*a* to minimize intrusion of the tray within the interior capacity of the associated beverage cooler container 10*a*. The beverage cooler container 10*a* includes a conventional container formed with a floor, sides walls, end walls, and a pivotally mounted lid. A second support tray is spaced and secured adjacent an opposed side wall of the beverage cooler container and is of a mirror image configuration to that of the first support tray including an arcuate forward face 12*a*. Each of the support trays is formed with cylindrical cavities including a first, second, and third cylindrical cavity 13, 14, and 15 respectively directed orthogonally downwardly relative to an upper surface of the first support tray 11 with a fourth, fifth, and sixth cylindrical cavity 16, 17 and 18 respectively directed orthogonally downward from an upper surface of the second support tray 12. Each of the cylindrical cavities is defined by a cylindrical wall set forth as a first cylindrical wall 13, a second cylindrical wall 14, a third cylindrical wall 15, a fourth cylindrical wall 16, fifth cylindrical wall 17, and a sixth cylindrical wall 18. Six cylindrical cavities are utilized to accommodate the typical six-pack of beverage packaging provided in commercial dispensing of beverages.

Each of the cylindrical walls 13 through 18 is defined by a circular array of arcuate base slits 19 underlying a series of wall slits 20. The wall slits 20 are arranged in a parallel relationship to one another and disposed axially about each cylindrical wall 13*a* through 18*a*. The arcuate base slots are of enhanced strength and minimize sheering of the connecting webs securing the perforated bottom wall 21 of each of the container receiving cylindrical cavities 13 through 18. The bottom wall 21 is perforated, as are the slots 19 and 20 positioned within the cylindrical walls 13*a* through 18*a*, to effect a maximum surface area of contact by each of the beverage containers "C" contained within each cylindrical cavity while maintaining an enhanced degree of structural integrity of each of the cylindrical walls.

Each of the support trays 11 and 12 includes a first "U" shaped support bracket 22 formed with upwardly extending legs, each provided with terminal ends interfitting into opposed rear corners of each support tray with a first "U" shaped support bracket 22 extending into the rear corners of the first support tray 11 and a second "U" shaped support bracket 23 extending to the rear corners of the second support tray 12. The "U" shaped support brackets maintain the desired orientation of the support trays above the floor of the beverage cooler container 10*a*.

The first support tray includes a pair of spaced parallel first rigid support rods including a first rigid support rod 24 and a second rigid support rod 25 extending outwardly from opposite terminal ends of the forward face 11*a*. The rigid support rods 24 and 25 are each respectively received telescopingly within a first support sleeve 26 and second support sleeve 27 each orthogonally directed into the terminal ends of the second forward face 12*a*. Each support rod and support sleeve are orthogonally and integrally secured to each respective forward face of each respective support tray to maintain the top surfaces of each support 11 and 12 respectively in a generally coplanar relationship with one another and orient the associated cavities 13 through 18 upwardly for ease of access of containers positioned within the cavities. A first spring 28 is captured interiorly of the first support sleeve 26 in abutment with a forward end of the associated first rigid support rod 24, while similarly a second spring 29 is captured within the second sleeve 27 in confronting and abutting relationship with the second rigid support rod 25, per the illustration of FIG. 2. The springs 28 and 29 maintain the trays 11 and 12 in a spaced relationship with one another and when positioned within a container 10*a*, maintain the trays against the opposed side walls of the associated container to maximize the cavity opening defined between each of the support trays to enhance ease of access interiorly of the associated beverage cooler container 10*a*.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A beverage cooler insert for use in combination with a container wherein said container includes spaced side walls, spaced end walls, a floor integrally formed to the side and end walls, and a closure lid, said insert comprising, a first tray including a first upper surface and a downwardly directed forward surface, and a second tray including a second upper surface and a downwardly directed forward surface, and a first support means and a second support means each adjustably mounted between said first and second trays to adjustably mount the insert interiorly of the container, and wherein the first support means includes a first rigid rod integrally secured at one end to the first forward surface and telescopingly received at its other end within a first support sleeve, the support secured integrally to the second support surface remote from the rigid rod, and the second support means includes a second rigid rod integrally secured at one end to the first forward surface and telescopingly received at its other end within a second support sleeve, the second support sleeve secured at its other end remote from the rigid rod integrally to the second forward surface, and wherein the first support sleeve and the first rigid rod are coaxially aligned with one another, and the second support sleeve and the second support rod are coaxially aligned with one another.

2. A beverage cooler insert as set forth in claim 1 wherein the first rigid rod and the first support sleeve are spaced from and parallel to the second rigid rod telescopingly received within the second support sleeve.

3. A beverage cooler insert as set forth in claim 2 wherein the first upper surface and the second upper surface are coplanar with one another.

4. A beverage cooler insert as set forth in claim 3 wherein the first tray includes a first series of cylindrical cavities, and the second tray includes a second series of cylindrical cavities, each cylindrical cavity defined by a cylindrical wall extending downwardly from each tray.

5. A beverage cooler insert as set forth in claim 4 wherein each cylindrical wall includes a circular array of arcuate base slots positioned adjacent the base of each cylindrical wall underlying an arcuate series of wall slots overlying the arcuate slots.

6. A beverage cooler insert as set forth in claim 5 wherein a first spring is captured between the first support rod and the second upper surface, and a second spring is captured between the second support rod and the second surface to resiliently bias the first tray outwardly relative to the second tray to secure each tray against opposed end walls of the container.

7. A beverage cooler insert as set forth in claim 6 wherein each cylindrical cavity is defined at its lower end by a perforated floor wherein the floor enables flow of a cooling medium to a container contained within each cylindrical cavity.

8. A beverage cooler insert as set forth in claim 7 wherein a first "U" shaped support bracket includes upwardly extending legs integrally secured to a bottom surface of the first tray, and a second "U" shaped bracket includes upwardly extending legs integrally secured into a bottom surface of the second tray, and wherein each "U" shaped support bracket spaces each respective tray above the floor of the container.

* * * * *